US006336568B1

(12) United States Patent
Tucker et al.

(10) Patent No.: US 6,336,568 B1
(45) Date of Patent: Jan. 8, 2002

(54) CUTLERY UTENSIL DISPENSER

(76) Inventors: Terence Tucker, 611 Calle Embocadura, San Clemente, CA (US) 92673; Robert Tucker, 16880 Avenida De Santa Ynez, Pacific Palisades, CA (US) 90272

( * ) Notice: Subject to any disclaimer, the term of this patent is extended or adjusted under 35 U.S.C. 154(b) by 0 days.

(21) Appl. No.: 09/525,815

(22) Filed: Mar. 15, 2000

(51) Int. Cl.[7] ..... B65G 59/00
(52) U.S. Cl. ..... 221/131; 221/197
(58) Field of Search ..... 221/197, 92, 131, 221/123, 132, 196, 277, 266, 265, 282; 206/553; 312/42

(56) References Cited

U.S. PATENT DOCUMENTS

| | | | | |
|---|---|---|---|---|
| 1,259,927 A | | 3/1918 | Swift | |
| 1,546,077 A | | 7/1925 | Hunter et al. | |
| 1,547,151 A | * | 7/1925 | Watling | 221/131 |
| 1,675,510 A | | 7/1928 | Nolan | |
| 1,886,378 A | | 11/1932 | Dearsley | |
| 2,053,828 A | | 9/1936 | Harper | |
| 2,078,984 A | | 5/1937 | Williamson | |
| 2,239,196 A | * | 4/1941 | Lunvik | 221/131 |
| 2,421,782 A | * | 6/1947 | Gibbs et al. | 221/92 |
| 2,571,668 A | | 10/1951 | Booth et al. | |
| 2,868,344 A | | 1/1959 | Shields | |
| 2,954,948 A | | 10/1960 | Johnson | |
| 2,965,262 A | | 12/1960 | Du Bois | |
| 3,095,114 A | | 6/1963 | Tobias | |
| 3,163,327 A | * | 12/1964 | Maxwell | 221/197 |
| 3,300,087 A | | 1/1967 | Kuypers | |
| 3,334,784 A | | 8/1967 | Morrison | |
| 3,558,006 A | | 1/1971 | Redmond | |
| 3,680,736 A | | 8/1972 | Viessmann | |
| 4,489,854 A | | 12/1984 | Wenkman et al. | |
| 4,662,536 A | | 5/1987 | Powers | |
| 4,896,792 A | | 1/1990 | Marchaud | |
| 5,191,997 A | * | 3/1993 | Squitieri | 221/282 |
| 5,586,685 A | | 12/1996 | Dorner et al. | |

* cited by examiner

*Primary Examiner*—Kenneth W. Noland
(74) *Attorney, Agent, or Firm*—Stetina Brunda Garred & Brucker

(57) ABSTRACT

A cutlery utensil dispenser for dispensing cutlery utensils one at a time upon hand operation of an externally accessible utensil delivery controller. The dispenser includes a housing having at least one interior compartment in communication with an exit opening. At least partially accommodateable within the interior compartment is a stack of utensils within a cartridge capable of universally accommodating knives or forks or spoons and provided with a portal through which a single utensil can pass and wherein a dispensable utensil is situated. The portal is situated in a pathway aligned with the exit opening. Finally, the utensil delivery controller is an externally accessible hand operable ejector engageable with the dispensable utensil and situated for ejecting the dispensable utensil from the portal of the cartridge and thereafter through the pathway to the exit opening for ultimate user retrieval. The utensil dispenser accomplishes maintenance of cleanliness of all utensils without individual wrap while delivering clean utensils one at a time to respective individual users.

13 Claims, 9 Drawing Sheets

CUTLERY UTENSIL DISPENSER

FIELD OF THE INVENTION

The present invention relates in general to hand-operable dispensers for dispensing goods, and in particular to a cutlery utensil dispenser for dispensing eating utensils one at a time upon activation of an externally accessible hand operable ejector.

BACKGROUND OF THE INVENTION

The fast-food, self-serve, restaurant industry has become a major, if not primary, destination of individuals and families who now are eating out more often for breakfast, lunch, and dinner. While such restaurants are generally pleasant and usually serve adequately nutritious fare, these establishments generally do not provide any upscale amenities as found in a typical sit-down restaurant with wait service. One particular area of concern is found in providing cutlery utensils for self-selection by customers. Specifically, at the present time a restaurant of this type has only two choices which are (1) providing individually wrapped, and therefore relatively expensive, utensils, or (2) providing a bin or container filled with unwrapped utensils into which all customers place their hands to retrieve a fork, knife, and spoon. As is apparent, the former approach assures cleanliness, while the latter approach, although relatively economical, is not a visually appealing choice and can spread hand-carried bacteria and the like to remaining unwrapped utensils for potential ultimate transmission to future customers.

In view of this important cleanliness issue of bin-held utensils as balance by economic concerns found in providing individually wrapped utensils, it is apparent that a need is present for equipment that can maintain and supply clean utensils without requiring individually wrapped knives, forks, and spoons. Accordingly, a primary object of the present invention is to provide a cutlery utensil dispenser capable of dispensing utensils one at a time while maintaining remaining utensils in a sequestered environment.

Another object of the present invention is to provide a utensil dispenser wherein a cartridge filled with utensils cooperates with a hand operable utensil ejector which is integral with the dispenser such that ejector operation engages one utensil which is then delivered for user retrieval.

Yet another object of the present invention is to provide a utensil dispenser wherein a plurality of identically constructed cartridges, which selectively can respectively house knives, forks, and spoons, can be accommodated respectively by a single dispenser.

These and other objects of the present invention will become apparent throughout the description thereof which now follows.

SUMMARY OF THE INVENTION

The present invention is a cutlery utensil dispenser for dispensing cutlery utensils one at a time upon hand operation of an externally accessible utensil delivery controller. The dispenser first comprises a housing having an interior compartment in communication with an exit opening. At least partially accommodateable within the interior compartment of the housing is a stack of utensils within a cartridge that is provided with a portal through which a single utensil can pass and wherein a dispensable utensil is situated. The portal is situated in a pathway aligned with the exit opening of the interior compartment. Cartridge construction preferably is such that any of a respective stack of knives, forks, or spoons can be accommodated within a single universal cartridge configuration. Finally, the utensil delivery controller is an externally accessible hand operable ejector engageable with the dispensable utensil and situated for ejecting the dispensable utensil from the portal of the cartridge and thereafter through the pathway to the exit opening for ultimate user retrieval.

A second embodiment of the present cutlery utensil dispenser can include a plurality of interior compartments each in communication with a respective exit opening and a plurality of respective cartridges each within one interior compartment. Each compartment has in association therewith a hand operable ejector operable as above described such that respective utensils can be dispensed one at a time from each of the cartridges.

One preferred ejector operable as defined above is a hand-rotatable roller with at least one protruding ledge. Rotation of the roller causes the protruding ledge to engage the dispensable utensil and eject the utensil from the portal to the exit opening for user pick up. A second preferred ejector is a lever having a protruding distal end. Pivotal movement of the lever causes the distal end to engage the dispensable utensil and thereafter eject that utensil from the portal to the exit opening for user retrieval. In the manner above described, the utensil dispenser here defined accomplishes maintenance of cleanliness of all utensils without individual wrap while delivering clean utensils one at a time to respective individual users.

BRIEF DESCRIPTION OF THE DRAWINGS

An illustrative and presently preferred embodiment of the invention is shown in the accompanying drawings in which.

DETAILED DESCRIPTION OF THE PREFERRED EMBODIMENTS

Figure 1:
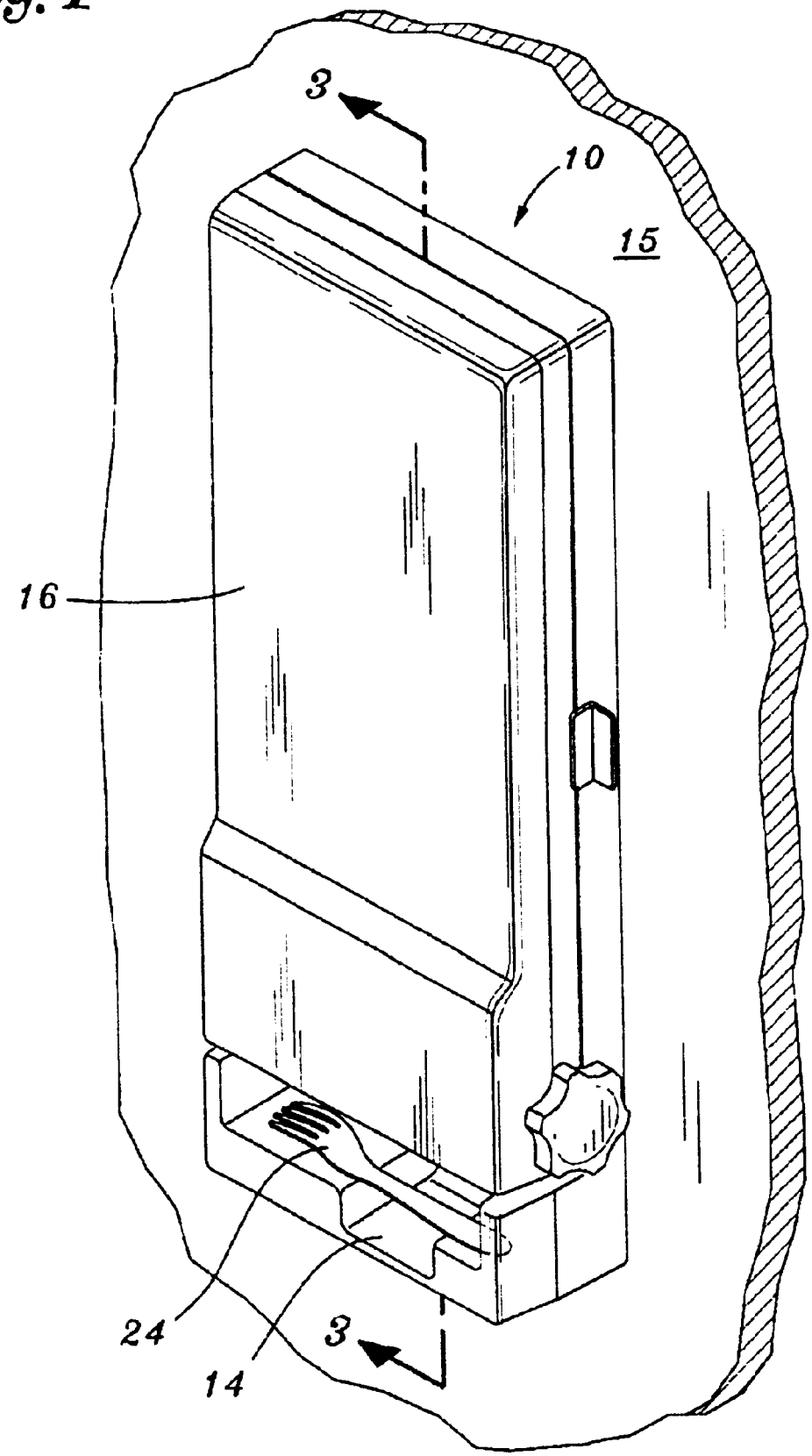
FIG. 1 is a perspective view of a first embodiment of a cutlery utensil dispenser mounted to a wall.
Figure 2:
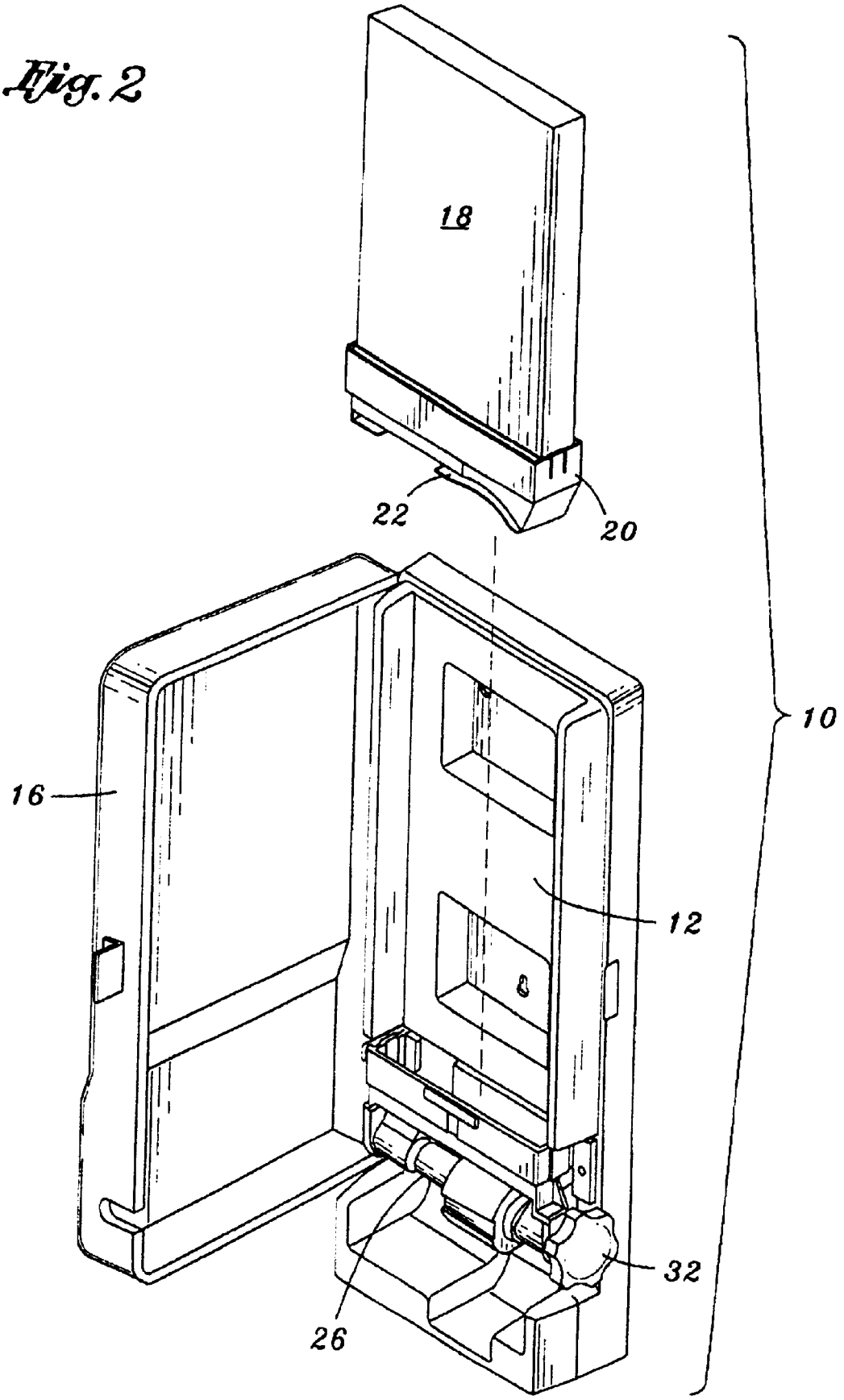
FIG. 2 is a perspective view of the dispenser of FIG. 1 in an open configuration with a utensil cartridge for positioning therein.
Figure 3:
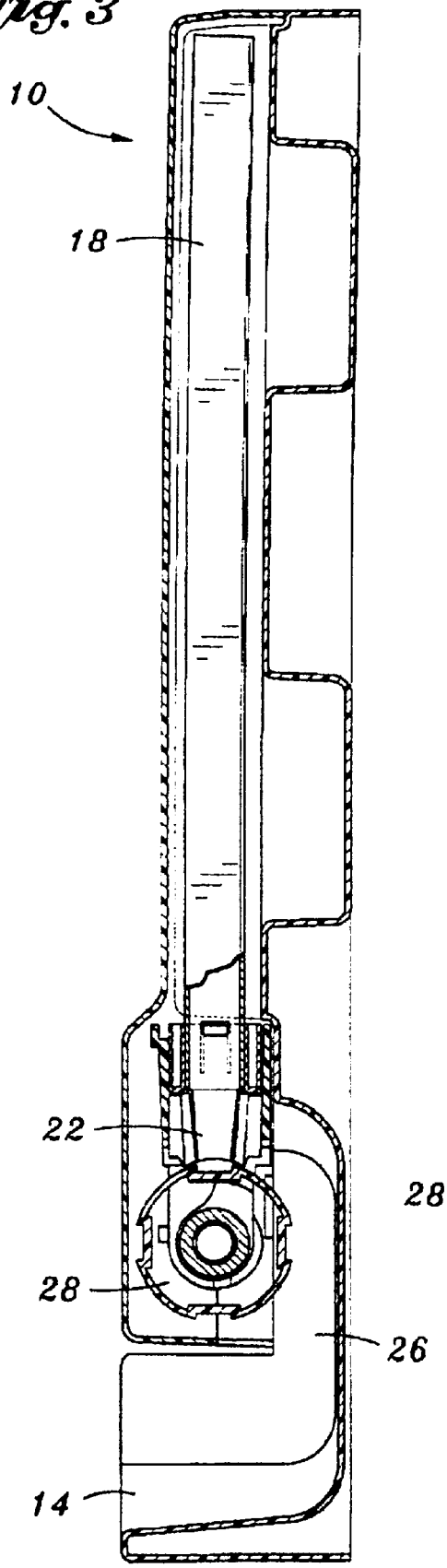
FIG. 3 is a side elevation view in section along line 3—3 of FIG. 1.
Figure 4:
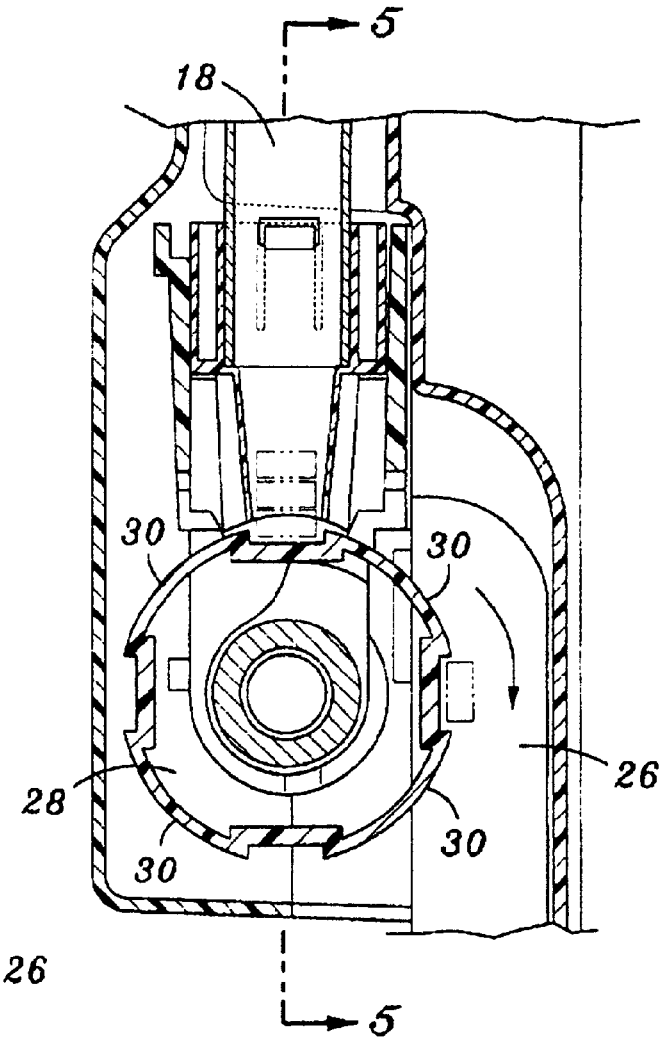
FIG. 4 is an enlarged side elevation view in section of the lower portion of FIG. 3.
Figure 6:
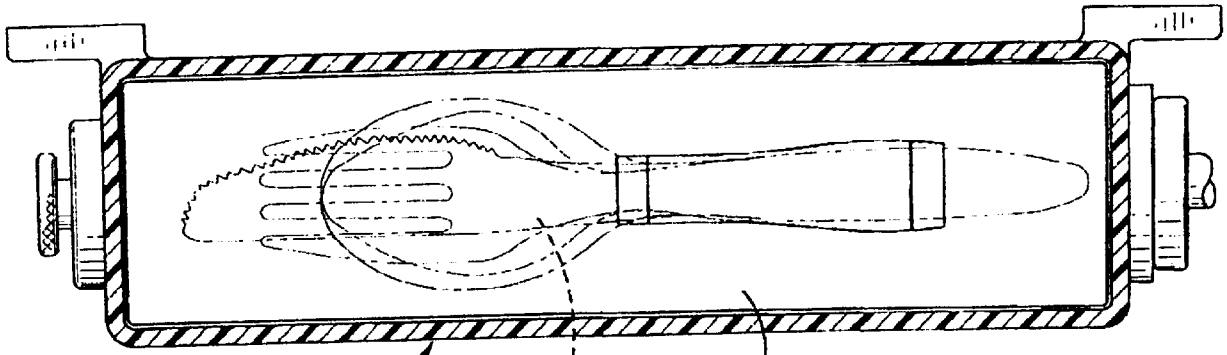
FIG. 6 is a top plan view in section of the cartridge of FIG. 2 within the dispenser.
Figure 5:
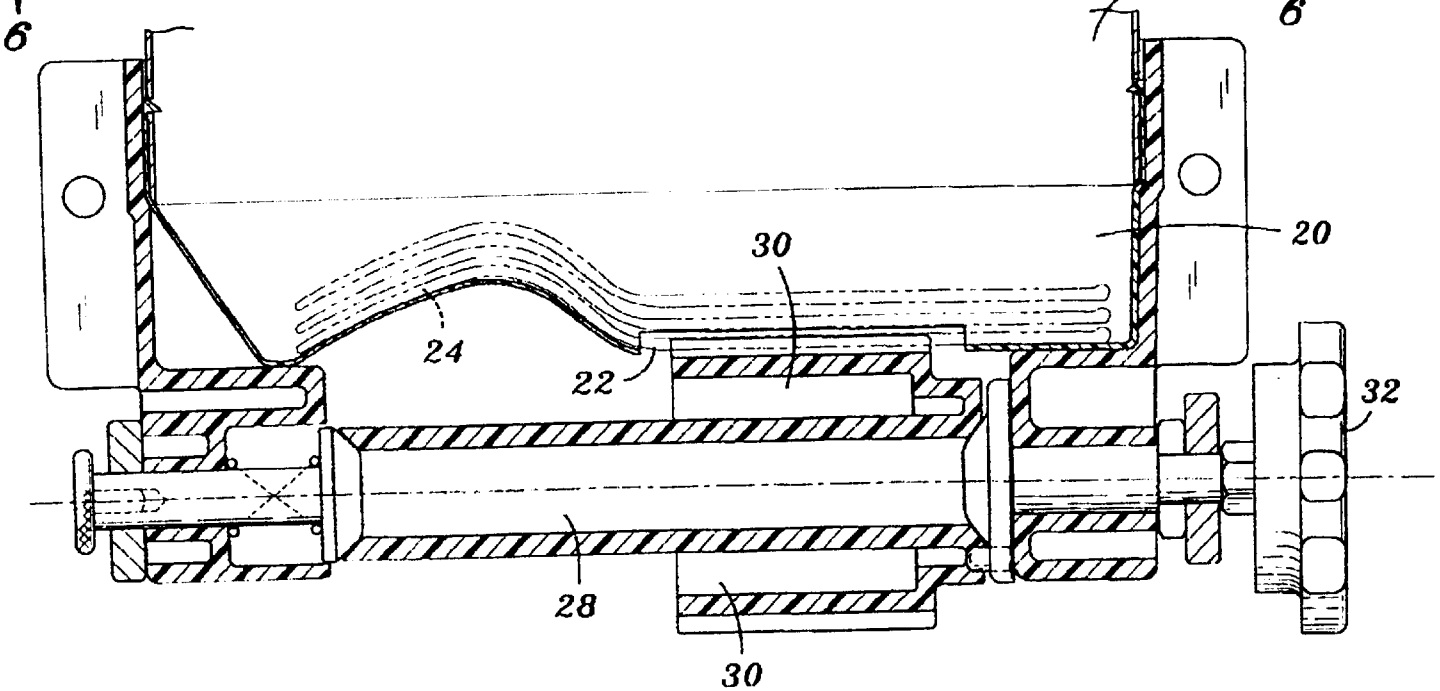
FIG. 5 is a front elevation view in section along line 5—5 of FIG. 4.

Referring first to FIGS. 1–6, a cutlery utensil dispenser 10 is shown mounted to a wall 15. The dispenser 10 includes an interior compartment 12 in communication with an exit opening 14 and accessible through a closable door 16. As shown particularly in FIG. 2, a cartridge 18 is accommodated within the interior compartment 12. The cartridge 18 has at its lower end a removable cap member 20 that provides a portal 22 leading from the interior of the cartridge 18. The portal 22 is sized such that a single cutlery utensil 24 can pass there through, and, in operation, the cartridge 18 has a stack of utensils 24 therein (illustrated in FIGS. 5 and 6) such that one dispensable utensil 24 is within the portal 22 at all times until the cartridge 18 is empty. It is to be noted that each individual cartridge 18 will have a stack of only one utensil (knife, fork, or spoon) as opposed to a combination of utensils, but that each cartridge 18 itself is interiorly sized to accept knives, forks, or spoons universally. Thus, as illustrated in FIG. 6 with the employment of phantom lines, a cartridge 18 can house a stack of knives or a stack of forks or a stack of spoons. The cartridge 18 itself can be constructed of plastic, cardboard, or other appropriately rigid material, while the cap member 20 preferably is constructed of plastic. When the cartridge 18 is in place within the interior compartment 12 of the housing 10, the portal 22 is situated in a pathway 26 aligned with the exit opening 14.

Dispensing a utensil 24 is accomplished in the embodiment of FIGS. 1–6 by user rotation of an externally accessible ejector here being a rotatable roller 28 having at least one, and here shown as four, protruding ledges 30. Upon rotation by a user of the external knob 32 of the roller 28, one such ledge 30 engages a dispensable utensil 24 situated within the portal 22 as above described to accomplish delivery of that utensil 24 through the pathway 26 and into the exit opening 14 for user retrieval. Each subsequent rotation of the knob 32 will result in like engagement of another utensil 24 that has replaced by gravity feed the immediately preceding now-ejected utensil 24.

Figure 7:
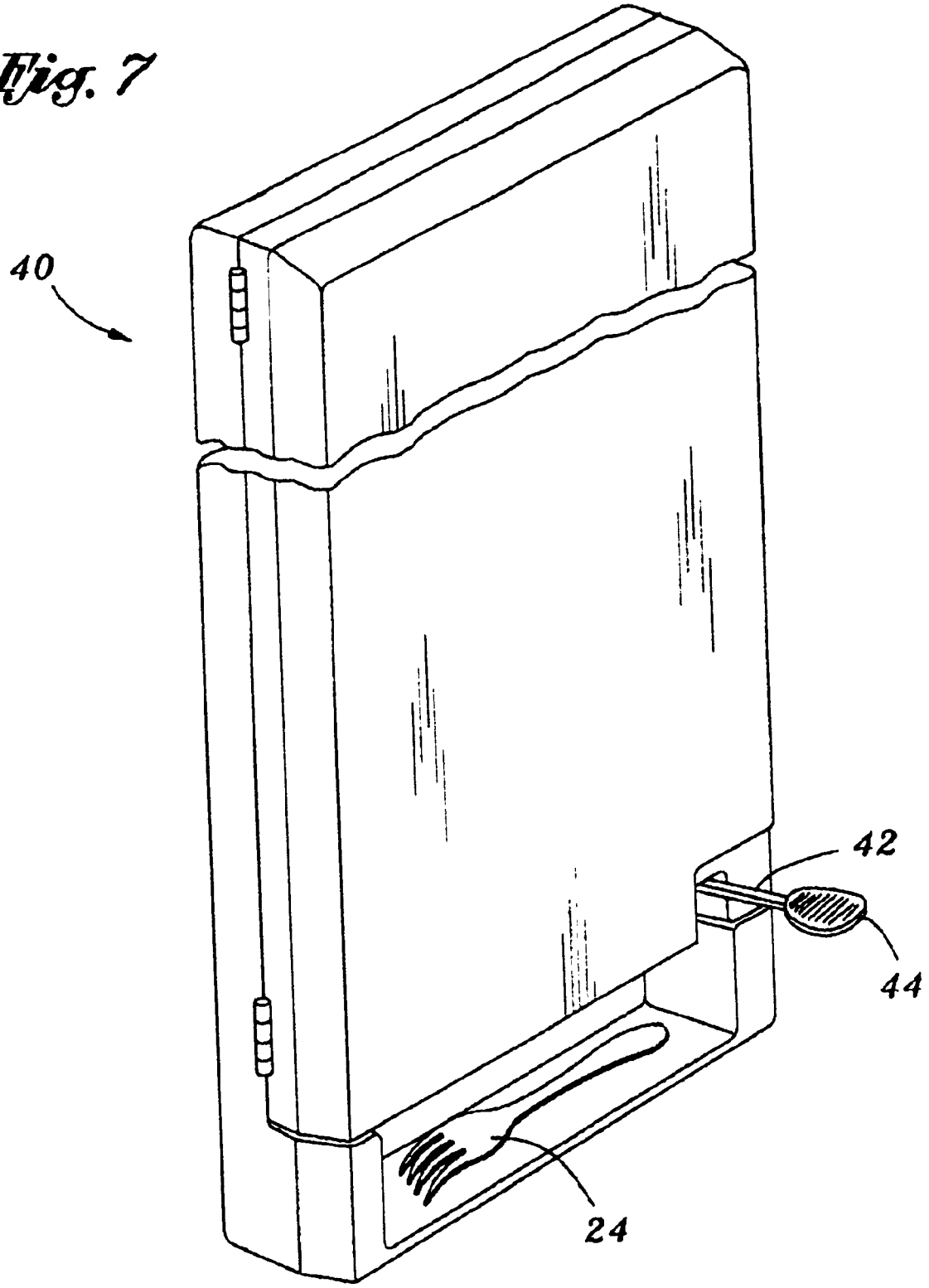
FIG. 7 is a perspective view of a second embodiment of a cutlery utensil dispenser.
Figure 8:
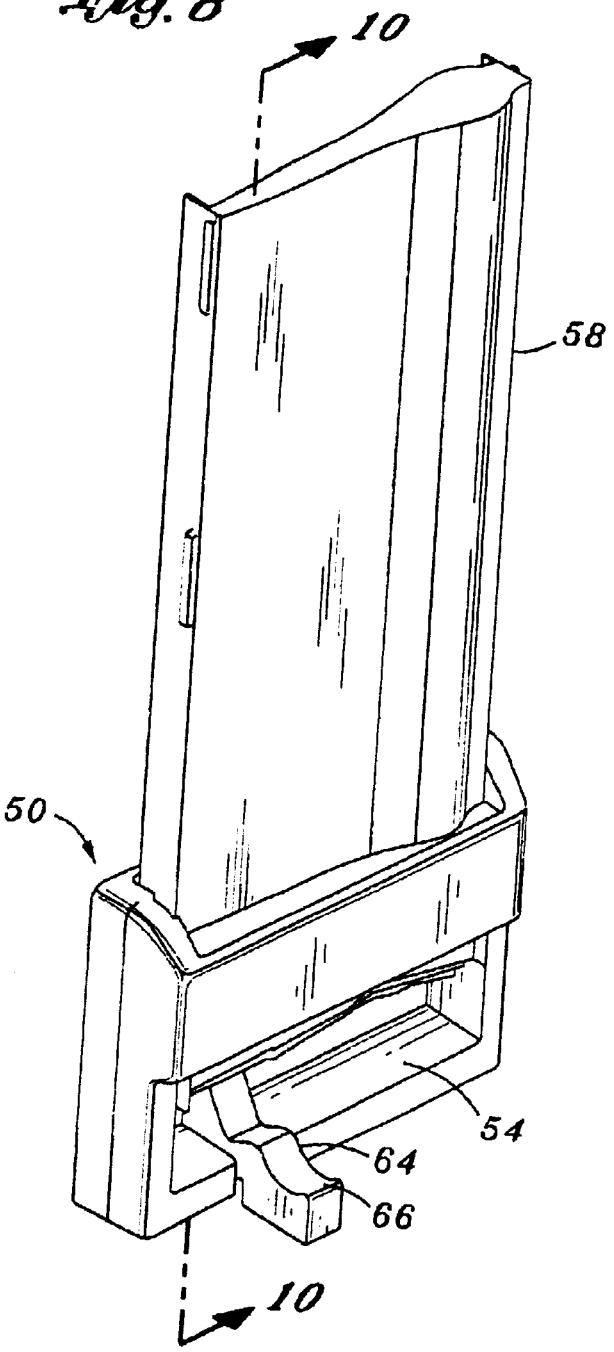
FIG. 8 is a front perspective view of a third embodiment of a cutlery utensil dispenser with a cartridge there accommodated.
Figure 9:
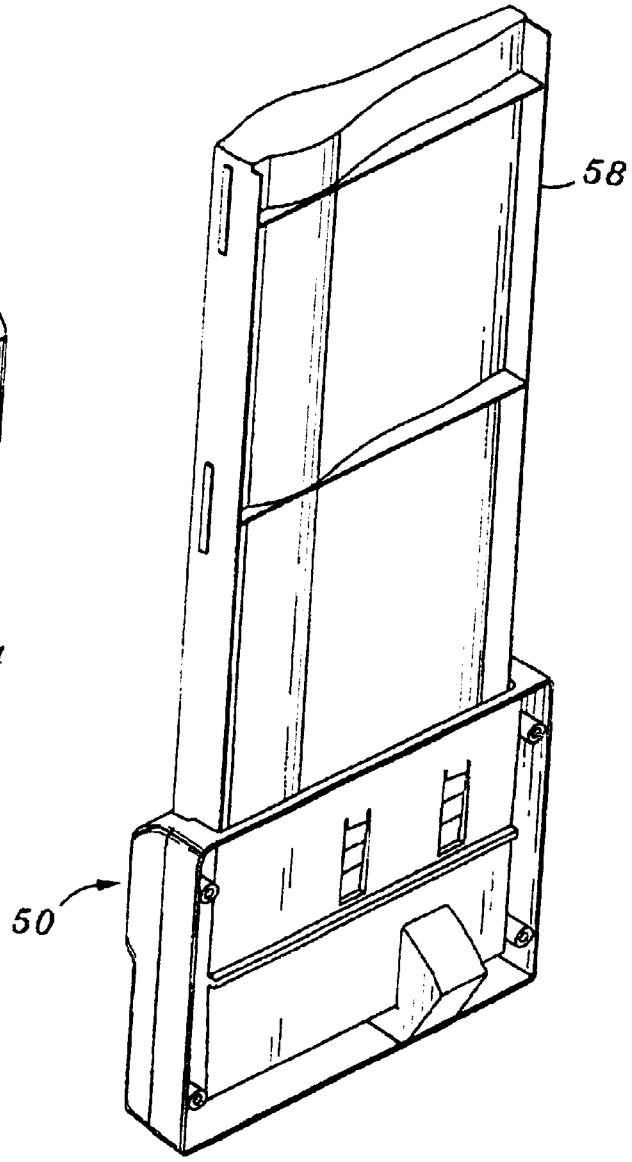
FIG. 9 is a rear perspective view of the dispenser and cartridge of FIG. 8.

FIG. 7 is a second embodiment of a cutlery utensil dispenser 40 of the same general construction as the embodiment of FIGS. 1–6 with a single exception being that of having as an externally accessible ejector a lever 42 whose proximal end 44 is pushed downwardly by a user to retrieve a utensil 24. Lever operation is substantially identical to that as described below in connection with the embodiment illustrated in FIGS. 8–11.

Figure 12:
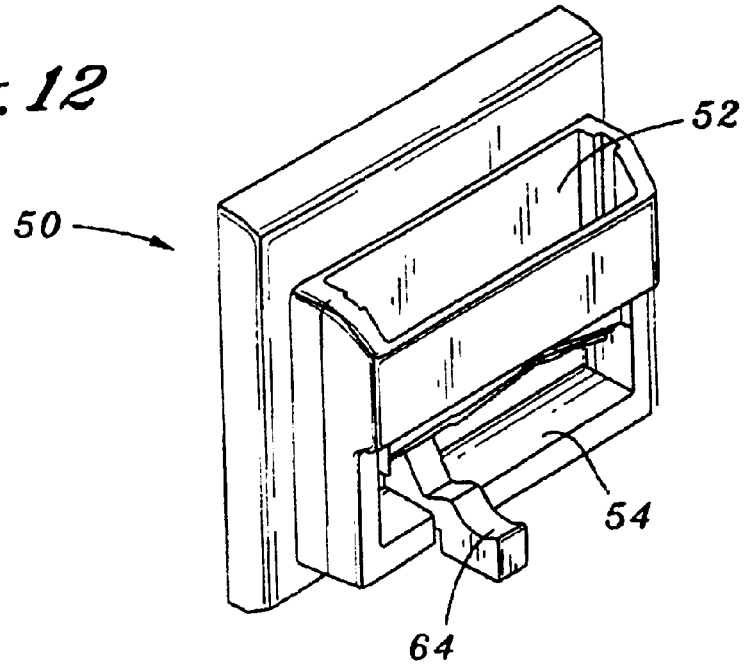
FIG. 12 is a perspective view of the dispenser alone of FIG. 8.

A third embodiment of a cutlery utensil dispenser 50 is shown in FIGS. 8–12, with FIG. 12 illustrating the dispenser 50 alone. The dispenser 50 includes an interior compartment 52 in communication with an exit opening 54. The interior compartment 52 accepts only a lower portion 56 of a cartridge 58 such that a portal 60 integral to the cartridge 58 is within the interior compartment 52. The portal 60 is sized such that a single cutlery utensil 24 can pass there through, and, in operation, the cartridge 58 has a stack of utensils 24 therein (FIG. 11) such that one dispensable utensil 24 is within the portal 60 at all times until the cartridge 58 is empty. It is to be noted that each individual cartridge 58 will have a stack of only one utensil (knife, fork, or spoon) as opposed to a combination of utensils, but, as earlier described, that each cartridge 58 itself is interiorly sized to accept knives, forks, or spoons universally. Thus, the illustration of forks 24 only in the cartridge 58 is for illustration only and is not meant to suggest utensil limitations. When the cartridge 58 is in place within the interior compartment 52 of the housing 50, the portal 60 is situated in a pathway 62 aligned with the exit opening 54.

Figure 10:
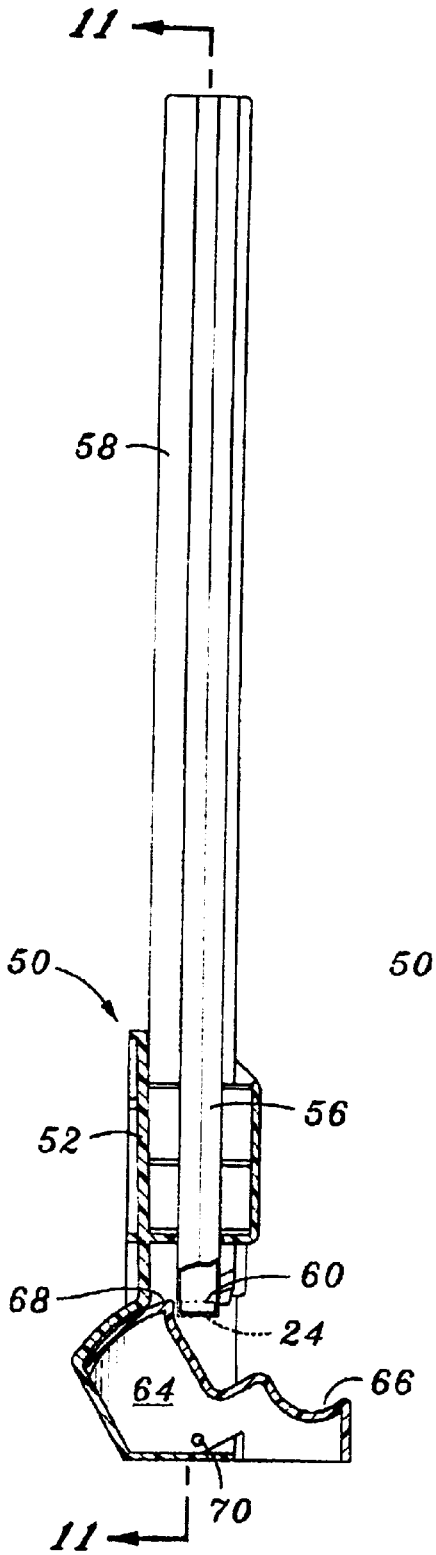
FIG. 10 is a side elevation view in section of the dispenser and cartridge of FIG. 8.
Figure 11:
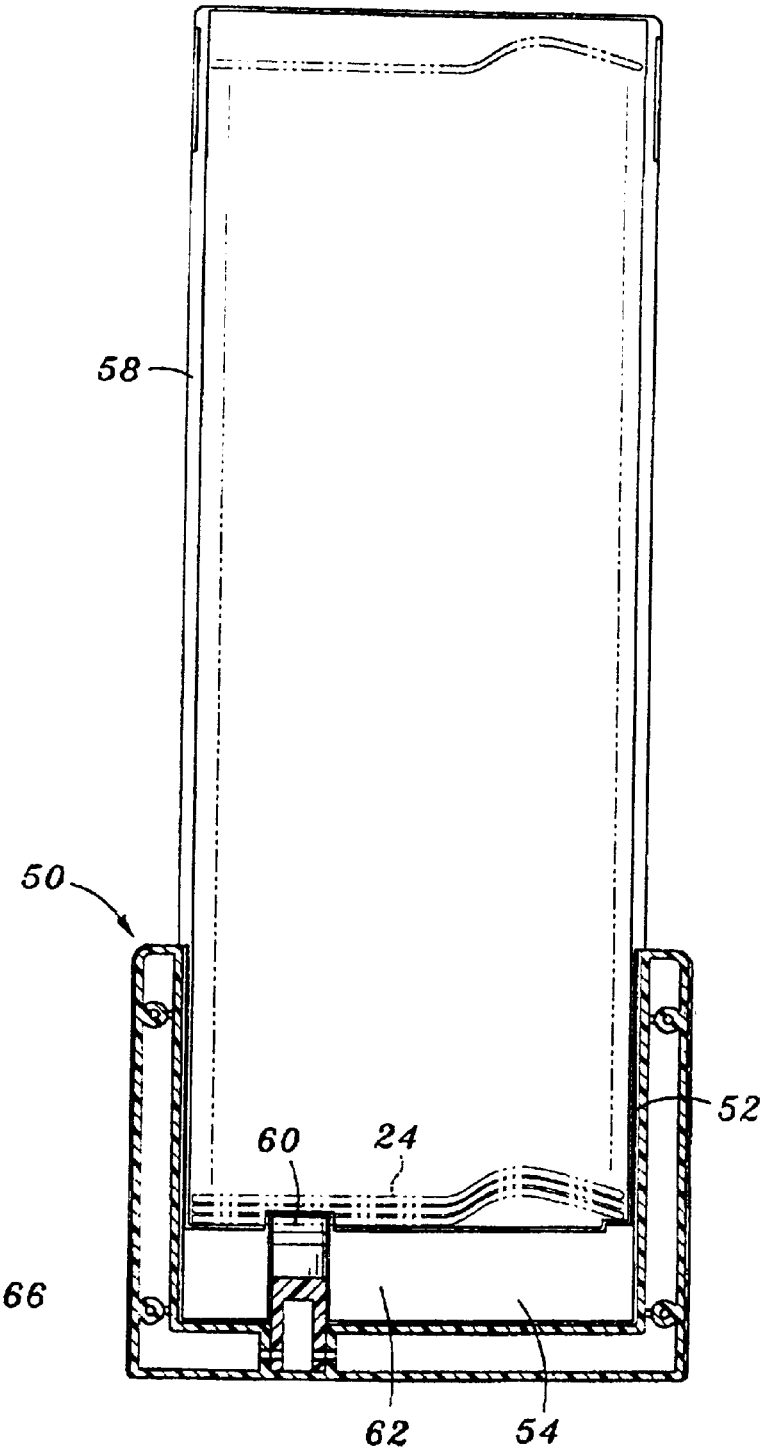
FIG. 11 is a front elevation view in section along line 11—11 of FIG. 10.

Dispensing of a utensil 24 is accomplished in the embodiment of FIGS. 8–12, as well as in the embodiment of FIG. 7, by user depression of an externally accessible ejector here being a lever 64 whose proximal end 66 is pushed downwardly by a user to retrieve a utensil 24. The lever 64 has an internally protruding distal end 68 wherein, upon pivotal movement of the lever 64 on its pivot point 70, which occurs upon depression of the proximal end 66, the protruding distal end 68 engages the dispensable utensil 24 for ejecting said utensil 24 from the portal 60 to the exit opening 54. Upon release of the lever 64, the distal end 68 thereof returns to its original position as shown in FIG. 10 and a subsequent utensil 24 drops in place within the portal 60 for subsequent ejection and delivery to the exit opening 54 upon user depression of the proximal end 66 of the lever 64. As noted above, the lever 42 of the embodiment of FIG. 7 is constructed substantially identically to that of the embodiment of FIGS. 8–12 to thereby accomplish utensil delivery from a cartridge 18 within the dispenser 40. As with the embodiment of FIGS. 1–6, the embodiments of FIG. 7 and of FIGS. 8–12 can be wall mounted as desired.

Figure 13:
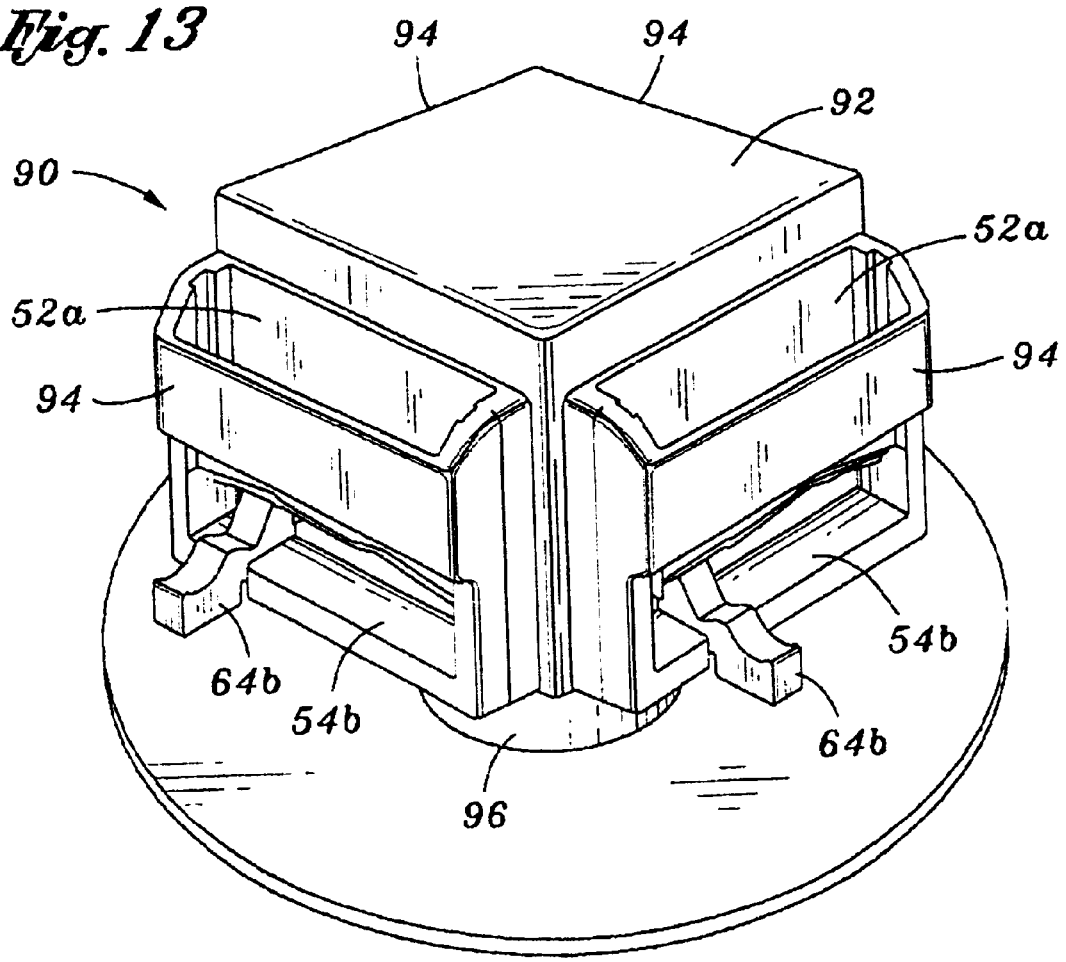
FIG. 13 is a perspective view of a fourth embodiment of a cutlery utensil dispenser.

Because multiple cartridges may be required to deliver a greater volume of one type of utensil or to deliver more than one utensil (i.e. knife, fork, and spoon), the embodiment of FIG. 13 permits such multiple deliveries. Specifically, the third embodiment shown in FIG. 13 is a multiple utensil dispenser 90 with a square housing 92 that provides four identical dispensers 94 (two shown) each disposed on one side of the square housing 92 and each identically constructed to the utensil dispenser 50 of FIGS. 8–12 with identical exit openings **54*b* and levers 64*b*. Interior compartments 52*a* likewise accept cartridges as described above in relation to the embodiment of FIGS. 8–12. The dispenser 90 is mounted to a conventional rotatable base 96** to thereby permit convenient placement on a table or counter for selective utensil retrieval.

Figure 14:
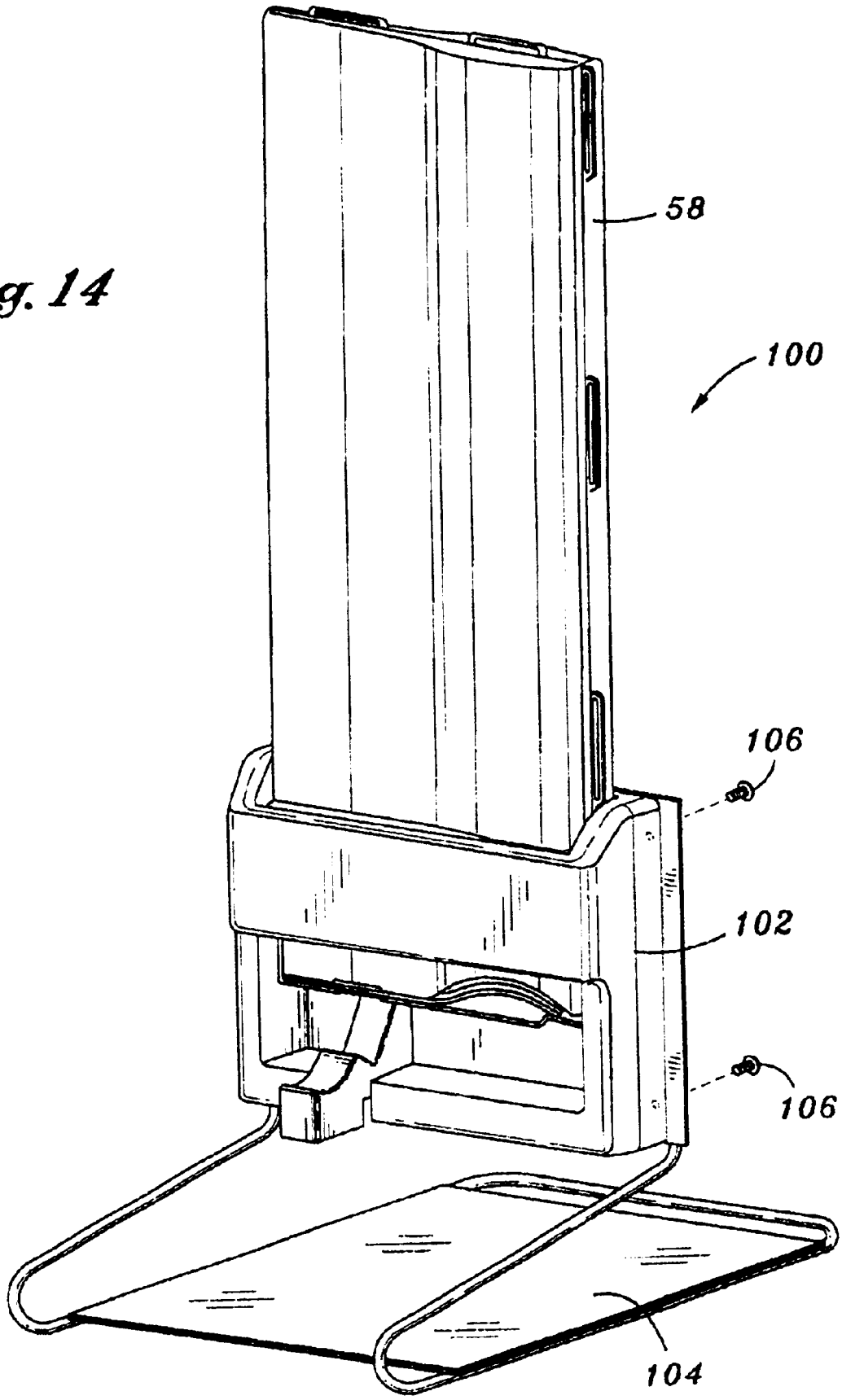
FIG. 14 is a perspective view of a fifth embodiment of a cutlery utensil dispenser.

FIG. 14 illustrates a fifth preferred embodiment of a self-supporting utensil delivery device 100 that includes a cutlery utensil dispenser 102 and a conventional metal standard 104 to which the dispenser 102 is mounted as with screws 106. The dispenser 102 is identical to that of the embodiment of FIGS. 8–12, identically accommodates a universal utensil cartridge 58, and identically dispenses utensils from the cartridge 58. As is apparent, the embodiment of FIG. 14 finds utility in environs where dispenser mounting is not feasible.

As is apparent, all of the embodiments described accomplish clean delivery of cutlery utensils one at a time, without requiring individually wrapped utensils, by delivering these utensils from easily and conveniently placed and replaced cartridges initially filled with utensils. While illustrative and presently preferred embodiments of the invention have been described in detail herein, it is to be understood that the inventive concepts here presented may be otherwise variously embodied and employed and that the appended claims are intended to be construed to include such variations except insofar as limited by the prior art.

What is claimed is:

1. A cutlery utensil dispenser for dispensing cutlery utensils one at a time upon hand operation of an externally accessible utensil delivery controller, the dispenser comprising:

a) a housing having an interior compartment in communication with an exit opening;

b) a cartridge and a stack of utensils within said cartridge, said cartridge at least partially accommodateable within the interior compartment of the housing and provided with a single portal through which a single utensil can pass and wherein a dispensable utensil is situated within said portal, said portal situated in a pathway aligned with said exit opening; and c) an externally accessible hand operable ejector operable without an activation step and engageable through grasp and release action with said dispensable utensil for ejecting the dispensable utensil from the portal through said pathway to the exit opening.

2. A cutlery utensil dispenser as claimed in claim 1 wherein the cartridge is sized to universally accommodate knives, spoons, and forks.

3. A cutlery utensil dispenser as claimed in claim 1 wherein the interior compartment of the housing accommodates the entire cartridge.

4. A cutlery utensil dispenser as claimed in claim 3 wherein the interior compartment of the housing is accessible through a closable door.

5. A cutlery utensil dispenser as claimed in claim 1 wherein the ejector comprises a rotatable roller with at least one protruding ledge wherein upon rotation of the roller the at least one protruding ledge engages the dispensable utensil for ejecting said utensil from the portal to the exit opening.

6. A cutlery utensil dispenser as claimed in claim 1 wherein the ejector comprises a lever having an internally protruding distal end wherein upon pivotal movement of the lever the protruding distal end engages the dispensable utensil for ejecting said utensil from the portal to the exit opening.

7. A cutlery utensil dispenser for dispensing cutlery utensils one at a time upon hand operation of an externally accessible utensil delivery controller, the dispenser comprising:

a) a housing having a plurality of interior compartments each in communication with a respective exit opening;

b) a plurality of cartridges and a stack of utensils within each said cartridge, with each said cartridge at least partially accommodateable within a respective interior compartment of the housing and provided with a respective single portal through which a single utensil can pass and wherein a dispensable utensil is situated within said respective portal, with each of said respective portals situated in a respective pathway aligned with said respective exit opening; and c) a respective externally accessible hand operable ejector operable without an activation step and associated with each respective interior compartment and engageable through grasp and release action with each respective dispensable utensil for ejecting the respective dispensable utensil from the respective portal through said respective pathway to the respective exit opening.

8. A cutlery utensil dispenser as claimed in claim 7 wherein the cartridge is sized to accommodate knives, spoons, and forks.

9. A cutlery utensil dispenser as claimed in claim 7 wherein each respective ejector comprises a respective lever having a respective internally protruding distal end wherein upon pivotal movement of said lever the respective protruding distal end engages the respective dispensable utensil for ejecting said utensil from the respective portal to the respective exit opening.

10. A cutlery utensil dispenser as claimed in claim 7 wherein the housing is mounted to a rotatable base.

11. A cutlery utensil dispenser for dispensing cutlery utensils one at a time upon hand operation of an externally accessible utensil delivery controller, the dispenser comprising:

a) a housing having at least one interior compartment in communication with an exit opening and capable of accommodating at least a portion of a cartridge housing a stack of utensils, said cartridge provided with a single portal through which a single utensil can pass and wherein a dispensable utensil can be situated, with said portal situated in a pathway aligned with said exit opening; and b) an externally accessible hand operable ejector operable without an activation step and engageable through grasp and release action with said dispensable utensil when situated within the portal of the cartridge for ejecting said dispensable utensil from the portal through said pathway to the exit opening.

12. A cutlery utensil dispenser as claimed in claim 11 wherein the ejector comprises a lever having an internally protruding distal end wherein upon pivotal movement of said lever the protruding distal end engages the dispensable utensil for ejecting said utensil from the portal to the exit opening.

13. A cutlery utensil dispenser as claimed in claim 11 wherein the housing is mounted to a rotatable base.

* * * * *